US006074199A

United States Patent [19]

Song

[11] Patent Number: 6,074,199

[45] Date of Patent: Jun. 13, 2000

[54] SOUND PRODUCING CANDLE

[76] Inventor: Jin Song, 13525 Denton Dr., Dallas, Tex. 75234

[21] Appl. No.: 09/170,302

[22] Filed: Oct. 13, 1998

Related U.S. Application Data

[63] Continuation-in-part of application No. 09/021,439, Feb. 10, 1998, Pat. No. 5,921,767.

[51] Int. Cl.[7] ..... F23D 3/02

[52] U.S. Cl. ..... 431/253; 431/289

[58] Field of Search ..... 431/253, 289, 431/298, 325

[56] References Cited

U.S. PATENT DOCUMENTS

| | | | |
|---|---|---|---|
| 2,291,067 | 7/1942 | Atkins | 431/325 |
| 3,917,441 | 11/1975 | Gray | 431/325 |
| 4,477,249 | 10/1984 | Ruzek et al. | 431/289 |
| 4,568,269 | 2/1986 | Lin | 431/253 |
| 5,363,590 | 11/1994 | Lee | 431/253 |

*Primary Examiner*—Carroll Dority
*Attorney, Agent, or Firm*—David W. Carstens; Carstens, Yee & Cahoon, L.L.P.

[57] ABSTRACT

The candle has a wick that contains a signal transmission means such as an optical guide or thermocouple. An electronic circuit is coupled to the transmission means so that when a light or heat signature is received by the circuit, it plays a sound stored in a memory. For example, an optical guide can be coupled to an optical switch, so that the optical signal produced by the flame will close the switch and complete a circuit. The circuit can include a storage device, such as an IC CHIP, to store a musical tune. This tune is then played when the candle is lit. When the flame is extinguished, the burnt wick along with the wavelength sensitive optical switches will prevent ambient light from activating the circuit. Likewise, if a thermocouple is used, the absence of a flame will discontiue the production of sound.

8 Claims, 2 Drawing Sheets

SOUND PRODUCING CANDLE

This application is a continuation-in-part of application Ser. No. 09/021,439 filed on Feb. 10, 1998 and now U.S. Pat. No. 5,921,767.

BACKGROUND OF THE INVENTION

1. Technical Field of the Invention

The present invention relates to a sound producing candle and specifically to a candle that produces a pleasing sound or a musical tune when the candle's wick is lit. The candle can also incorporate a fragrance for aromatherapy. Moreover, a replaceable candle can contain a transmission guide so that when the candle nests in a base, the guide can actuate a circuit to produce the sound.

2. Discussion of Related Art

Candles produce both necessary and pleasurable effects. The light can be used to illuminate rooms. As importantly, the quality of the light produces a more tranquil effect than overhead fluorescent bulbs and even incandescent bulbs. The flicker and warm glow of a candle has a soothing effect. To enhance the soothing effect, some prior art candles have incorporated a music storage device that is enabled upon the lighting of the candle.

U.S. Pat. No. 5,015,175 to Lee discloses a birthday candle that has a thermoresponsive member adjacent to the wick. When the candle is lit, the heat from the candle creates a voltage in the thermoresponsive member. The voltage drives a circuit having a memory. The memory can store a birthday tune. Therefore, when the candle is lit, the birthday tune is played. However, the Lee design has been shown to be unreliable. The heat from the flame is not constant, and if a breeze pushes the flame away from the thermoresponsive member, the tune will stop.

U.S. Pat. No. 4,477,249 to Ruzek et al. discloses a candle that includes an optical fiber adjacent to the candle's wick. The optical fiber runs through the body of the candle and is connected to an electrical circuit. When the candle is lit, its light is channeled through the optical fiber and closes an optical switch. Once the switch is closed, the circuit is completed and a semiconductor storage device containing a musical tune is activated. The tune is played on a speaker. As the wick burns, the optical fiber is melted away.

The Ruzek design suffers from the difficulty that it is easily triggered by ambient light in the room. In other words, if any light is on in the same room as the candle, then the music is played. Likewise, natural sunlight can trigger the candle. Another problem is that the electronics assembly is nested in the base of the candle, increasing the cost of producing the candle. Further, both the wick and the optical fiber must be suspended in the wax during the formation of the candle. If the spacing between the two diverges, the optical fiber may not be properly spaced for connection to the electrical circuit.

A need exists for a reliable, cost-effective candle that can play a musical tune or sound while burning. The candle should incorporate an electronic circuit that can be turned off even when the candle is lit. The volume of the song should be controllable. Further, the tune should stop when the candle is extinguished. In other words, ambient light should not trigger the circuit. Further there is a need for such a candle that automatically extinguishes itself after burning a prescribed length of the candle.

SUMMARY OF THE INVENTION

The present invention overcomes many of the disadvantages of the prior art candles, the most important one being the effect of ambient light. The present candle can use either an optical guide or a thermocouple within the wick that burns away at generally the same rate as the wick. It is well known that a wick blackens upon burning. This is due to the ash from the combustion of the wick. This ash is used to shield the optical guide when the candle is not in use. In other words, when the wick is lit, the flame's light is transmitted through the optical guide to an optical switch. However, when the candle is extinguished, the soot and ash on the remaining wick generally shield the optical guide from ambient light. As a further precaution, the optical switch can be tuned to activate only upon the reception of the light wavelength produced by the burning candle. In this manner the switch will not be activated even if the soot and ash are insufficient to shield the optical guide from ambient light.

Further, a second optical switch can be placed in the music producing circuit to aid in disconnecting the circuit whenever the candle is not burning. When the ambient light received at the second optical switch is brighter than the light coming through the optical guide, the circuit is disconnected. Thus, no power is delivered to the sound producing circuit when ambient light is brighter than the light from the candle.

The present invention can also be placed onto a base that contains the electronic circuit and memory means. The wick and optical guide in the candle will necessarily extend out of the base of the candle to engage the electronic circuit. The base of the candle can be configured to positively register with the base. For example, the candle base can have a off-centered peg portion that engages a similarly shaped port in the base. This forces the user to place the candle onto the base with the correct orientation. A further advantage of this embodiment, is that it allows the more expensive electronics to be placed into a reusable base, while the less expensive optical guide is placed in the disposable candle.

An embodiment of the invention may also contain a means for extinguishing the candle after it burns to a certain point or series of points on the length of the candle. This is accomplished by placing in series with the wick a non-combustible material. The flame is thus extinguished when it reaches the non-combustible material. This prevents the candle from being inadvertently consumed and requires that the candle be re-ignited for it to burn further.

Alternatively, the wick can contain a thermocouple that senses heat from the flame, thus triggering music. The thermocouple, when placed directly in the wick, has no choice but to experience the heat of the flame. Thus, this configuration is a significant improvement over the design disclosed in U.S. Pat. No. 5,015,175 to Lee discussed above.

Also, while the term music is used throughout, any sound could be produced. The sound can be stored in memory. The sound could be soothing, such as the sound of rain or the ocean, birds or the forest.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
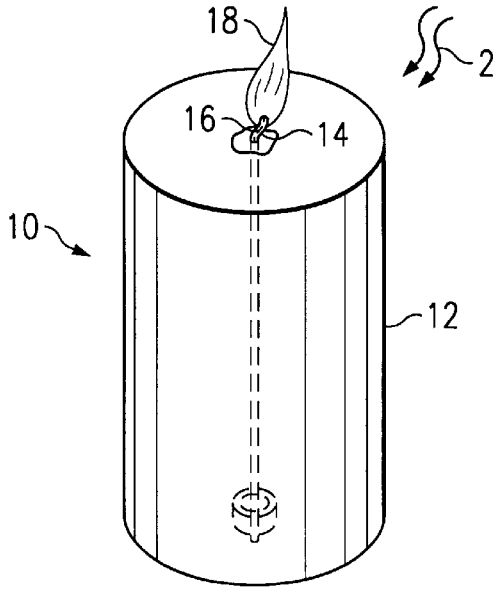
FIG. 1 is a sectional view across a candle embodying the present invention and having an optical guide or thermocouple within its wick.

Referring to FIG. 1, a candle 10 is shown which embodies the present invention. The candle 10 can have a generally cylindrical body 12 as shown or any other desirable shape. As expected, the candle will be made of a combustible material such as wax. The candle can also include coloring and/or a fragrance for use with aromatherapy. A wick 14 can located within the candle, preferably in an axial location as shown. A transmission guide 16, such as an optical guide or thermocouple, is located within the wick 14. If the transmission guide is an optical guide, it is preferably an optical fiber. In use, the wick is ignited to produce a flame 18. Once the flame is present, the wick and an amount of wax is consumed to produce the flame. However, the flame 18 produces sufficient light for an optical signal to be transmitted down the optical fiber or sufficient heat to transmit a signal down a thermocouple. For purposes of example, the guide 16 will generally be referred to as an optical guide.

In use, the optical signal is constant because the optical fiber is in the midst of the flame, thus supplying a sufficient quantity of light to the optical fiber. As the wick and wax are consumed, the optical fiber can also be consumed. In other words, the wick and optical fiber will stay approximately the same height relative to the top surface of the candle.

Figure 2:
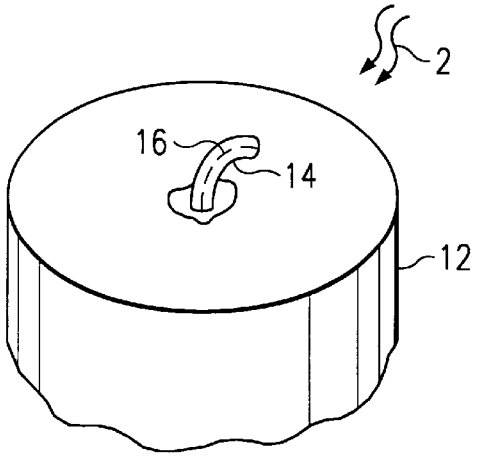
FIG. 2 is a detailed view of the wick showing the optical guide or thermocouple in the wick.

FIG. 2 illustrates a more detailed view of the wick 14 and optical guide 16. A deficiency with prior art candle designs is the impact of ambient light 2. The ambient light 2 should not trigger the playing of a musical tone when the candle is not lit. The exposed optical guide of Ruzek '249, discussed above, suffers from this flaw. By nesting the optical guide 16 into the wick 14, the effect of ambient light is greatly diminished. When the flame is extinguished, the wick has been burnt and blackened. This blackened wick prevents the ambient light from reaching the optical guide.

Figure 3:
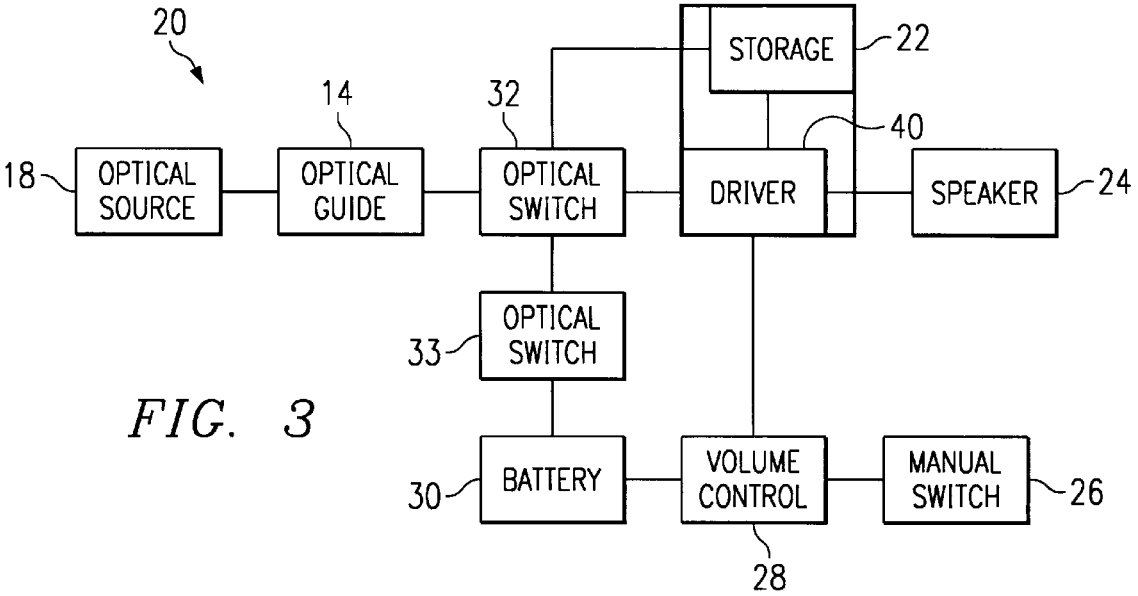
FIG. 3 is a block diagram of the electrical circuit used to implement the invention.

An electrical circuit 20, such as shown in FIG. 3, is used to generate the musical tune played. The optical source 18 is the light from the flame. Alternatively, the source could be the heat from the flame if a thermocouple is used. The optical guide 14 is the optical fiber nested in the wick. Alternatively, the guide could be the thermocouple. The optical signal carried down the optical guide is used to activate a first optical switch 32. The optical switch 32 is only activated when the wavelength of the optical signal matches the pre-determined wavelength for a burning candle. In other words, when the optical signal of the correct wavelength is sensed, then the switch is closed, completing the circuit 20. Thus, the optical switch 32 further diminishes the effect of ambient light. A second optical switch 33 is used to sense ambient light. When ambient light is brighter than the light produced by the candle is placed on the switch, the circuit is opened. This further prevents sound being played when the candle is not burning. Once the circuit is closed, a storage device 22 can produce an output to a speaker 24 through a driver 40. The storage 22 and driver 40 can be located on a single device. The storage device is preferably an IC CHIP, and the output is preferably a musical tune. However, it could also be spoken words, such as a poetry reading, a series of tones, or any other storable sound. A manual switch 26 can also be used to disable the circuit when only a burning candle is desired. A volume control 28 can be added to the circuit to allow the user the ability to adjust the loudness of the music. Finally, a voltage source 30 is also included to power the circuit. The voltage source could be batteries or even an AC power source.

Figure 4:
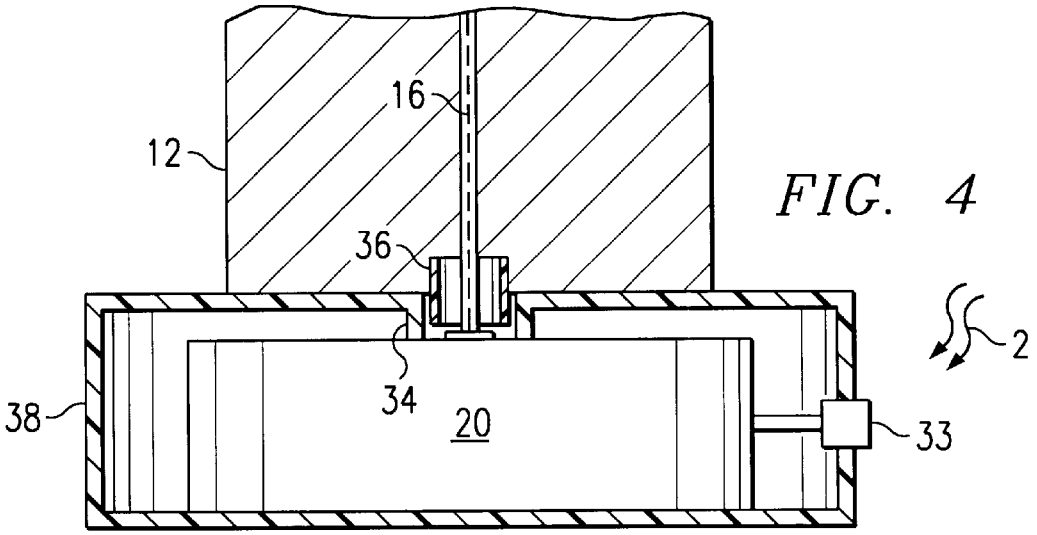
FIG. 4 is a sectional view across the candle and base of an alternate embodiment.

The circuit 20 can be located in various locations. In one embodiment, the circuit 20 is located in the base of the candle. In another embodiment, the circuit 20 is attached to the outside of the candle. In another embodiment the circuit 20 is located in a candle base 38, as shown in FIG. 4. In this embodiment, any number of replacement candles can be used with the same base. The replacement candles are less expensive because they would not need to include the electronic circuit 20. The transmission guide 16 must be properly aligned with the switch in the base 38. Therefore, the candle 12 must be positively registered with the base 38. This is accomplished with the use of tabs 36 located on the base of the candle 12 that align with notch 34 on the base. Any number of alignment methods can be used. Also attached to the base 38 is the second optical switch 33 used to sense ambient light 2.

Figure 5:
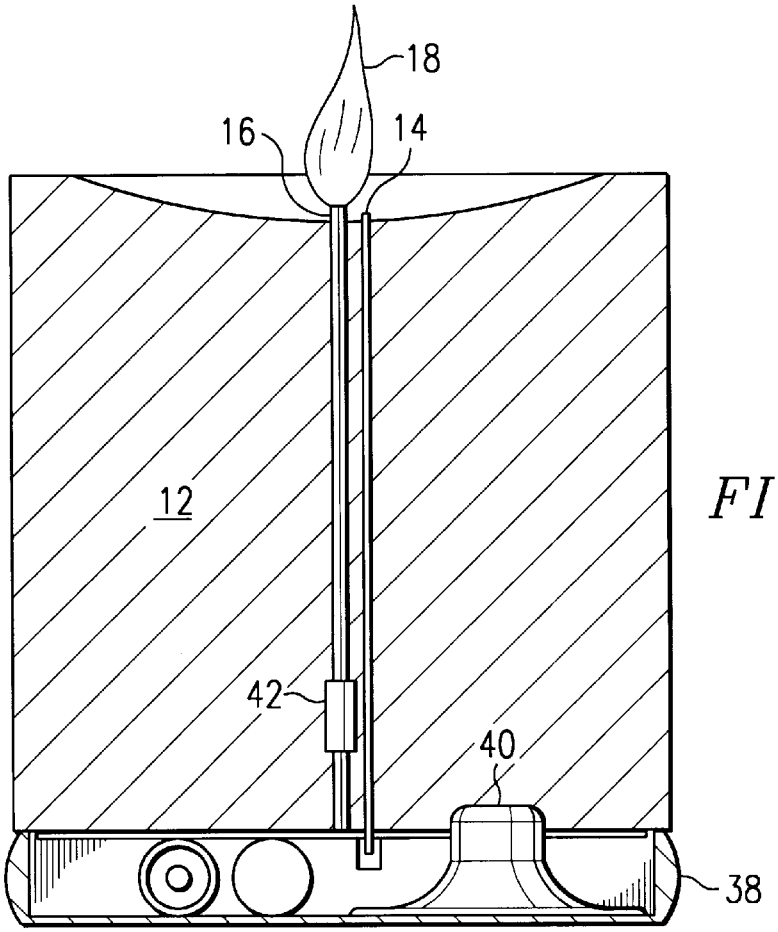
FIG. 5 is a side sectional view of the candle having a combustion block on said wick and registered onto a base.

FIG. 5 illustrates a candle 12 located in a base 38. The alignment tab 40 extends upward from the base, in a non-centered position. In this embodiment, the wick 14 includes a combustion stopper 42. The stopper can be a metallic plate or other non-combustible material. Thus, if the candle is left unattended, it will be less of a safety hazard. Further, in this embodiment, the transmission guide need not be located within the wick 14.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

I claim:

1. A candle comprising:

(a) a candle having a wick axially located within such that portions of the wick extend beyond both ends of the candle;

(b) a thermocouple located substantially within the wick.

2. The candle of claim 1 further comprises a fragrance within the candle.

3. The candle of claim 1 further comprising:

(d) a base upon which the candle can be placed.

4. The candle of claim 3 wherein said base contains means for producing sound.

5. The candle of claim 3 wherein said base and candle comprise registration means.

6. The candle of claim 4 wherein said means for producing sound further comprises a volume control.

7. The candle of claim 4 wherein said means for producing sound further comprises a manual switch.

8. The candle of claim 4 wherein said means for producing sound further comprises a voltage source.

* * * * *